US006948442B2

(12) United States Patent
Jerabek et al.

(10) Patent No.: US 6,948,442 B2
(45) Date of Patent: Sep. 27, 2005

(54) OUTFITTING SYSTEM FOR A PERSONAL WATERCRAFT

(75) Inventors: Jesse J. Jerabek, Greenville, SC (US); Anthony E. Lee, Easley, SC (US)

(73) Assignee: Watermark Paddlesports, Inc., Easley, SC (US)

( * ) Notice: Subject to any disclaimer, the term of this patent is extended or adjusted under 35 U.S.C. 154(b) by 0 days.

(21) Appl. No.: 10/726,969

(22) Filed: Dec. 2, 2003

(65) Prior Publication Data

US 2004/0107890 A1 Jun. 10, 2004

Related U.S. Application Data

(63) Continuation-in-part of application No. 10/215,361, filed on Aug. 7, 2002, now Pat. No. 6,729,259.

(51) Int. Cl.[7] ..... B63B 35/71
(52) U.S. Cl. ..... 114/347; 114/363
(58) Field of Search ..... 114/343, 363, 114/347; 297/284.6

(56) References Cited

U.S. PATENT DOCUMENTS

| | | | | |
|---|---|---|---|---|
| 2,094,499 A | | 9/1937 | Scavo | |
| 3,330,598 A | * | 7/1967 | Whiteside | 297/284.3 |
| 5,299,524 A | | 4/1994 | Szilagyi | |
| 5,671,694 A | | 9/1997 | Schoettle | |
| 6,022,255 A | | 2/2000 | Lukanovich | |
| 6,112,693 A | | 9/2000 | Addison | |
| 6,182,590 B1 | * | 2/2001 | Patera | 114/55.57 |
| 6,443,089 B1 | | 9/2002 | Goucher et al. | |
| 6,729,259 B2 | * | 5/2004 | Jerabek et al. | 114/347 |
| 6,736,084 B2 | | 5/2004 | McDonough et al. | |
| 2002/0175549 A1 | | 11/2002 | Hamilton et al. | |

FOREIGN PATENT DOCUMENTS

GB 2331235 5/1999

OTHER PUBLICATIONS

*Discovery Kayak Cushions* internet description page, Cascade Designs, Inc., p. 1, printed Jul. 22, 2004.
*Kayak Thigh Support Cushion* internet description page, Cascade Designs, Inc., p. 1, printed Aug. 20, 2004.
Newsgroups: Rec.boats.paddle, Subject: Klepper Seats, internet chatroom discussion page, dated Sep. 8, 1994.
Newsgroups: Rec.boats.paddle, Subject: SW Kayak for Sale, internet chatroom discussion page, dated Apr. 9, 1998, printed Dec. 2, 2002.

(Continued)

*Primary Examiner*—Sherman Basinger
(74) *Attorney, Agent, or Firm*—Kolisch Hartwell, PC

(57) ABSTRACT

One embodiment provides a personal watercraft, wherein the personal watercraft includes a cockpit configured to accommodate a user, a first item of outfitting coupled to the watercraft at least partially within the cockpit, wherein the first item of outfitting includes a first fluid-holding bladder inflatable by the user to increase the snugness of fit of the first item of outfitting on the user, a second item of outfitting coupled to the watercraft at least partially within the cockpit, wherein the second item of outfitting includes a second fluid-holding bladder inflatable by the user to increase the snugness of fit of the second item of outfitting on the user, a pump for inflating the first bladder and the second bladder, a fluid supply line connecting the first bladder and the second bladder to the pump, and a valve disposed along the fluid supply line, wherein the valve is configured to allow fluid flow from the pump to be selectively directed into at least one of the first bladder and the second bladder.

2 Claims, 7 Drawing Sheets

OTHER PUBLICATIONS

PaddleWise Discussion on Feathercraft K–Light and Kahuna, internet chatroom discussion page, dated Mar. 31, 1999, printed Nov. 22, 2002.

Newsgroups: Rec.boats.paddle.touring, Subject: Feathercraft K–Light Seat Alternatives, internet chatroom discussion pages (1–13), dated Mar. 23, 2000, printed Dec. 2, 2002.

*Feathercraft Hip Fit Kit* picture, instructions and internet description pages, Feathercraft Folding Kayaks, pp. 1–3, Nov. 2000.

*Dagger Unveils 2002 Technical Outfitting Innovations*, internet pp. 1–2, Dagger, Inc., Nov. 20, 2001.

*HipGrips Inflatable Hip Pads from Radical Gear Kayak Accessories*, internet p. 1, Radical Gear, dated at least as early as Apr. 3, 2002.

* cited by examiner

Fig. 2
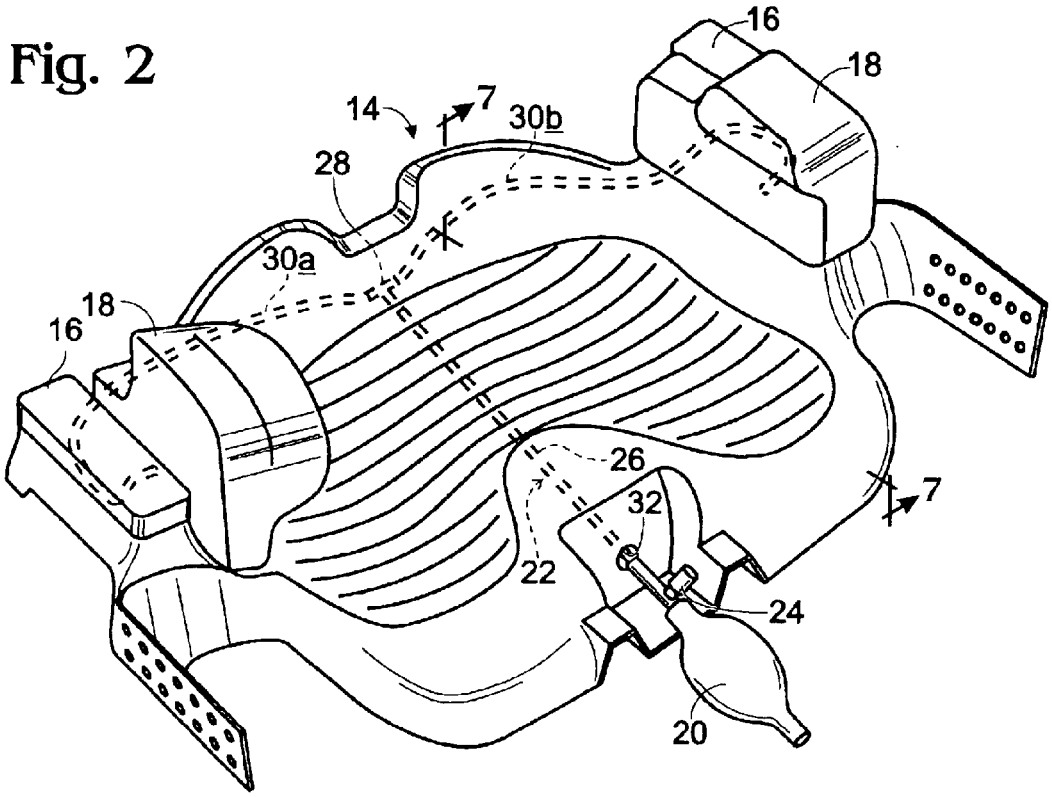
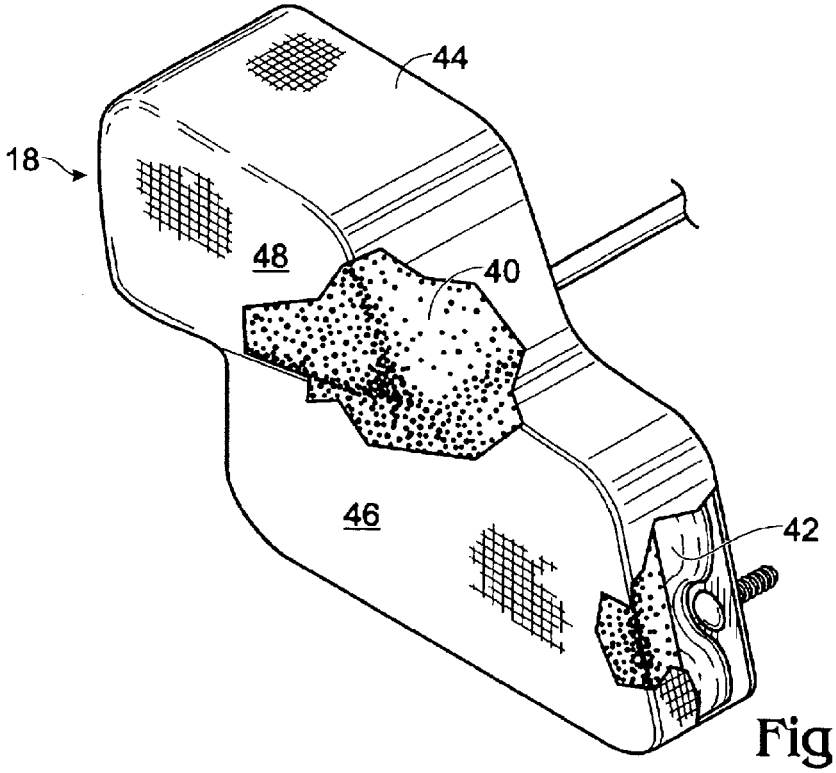
Fig. 3

Fig. 4
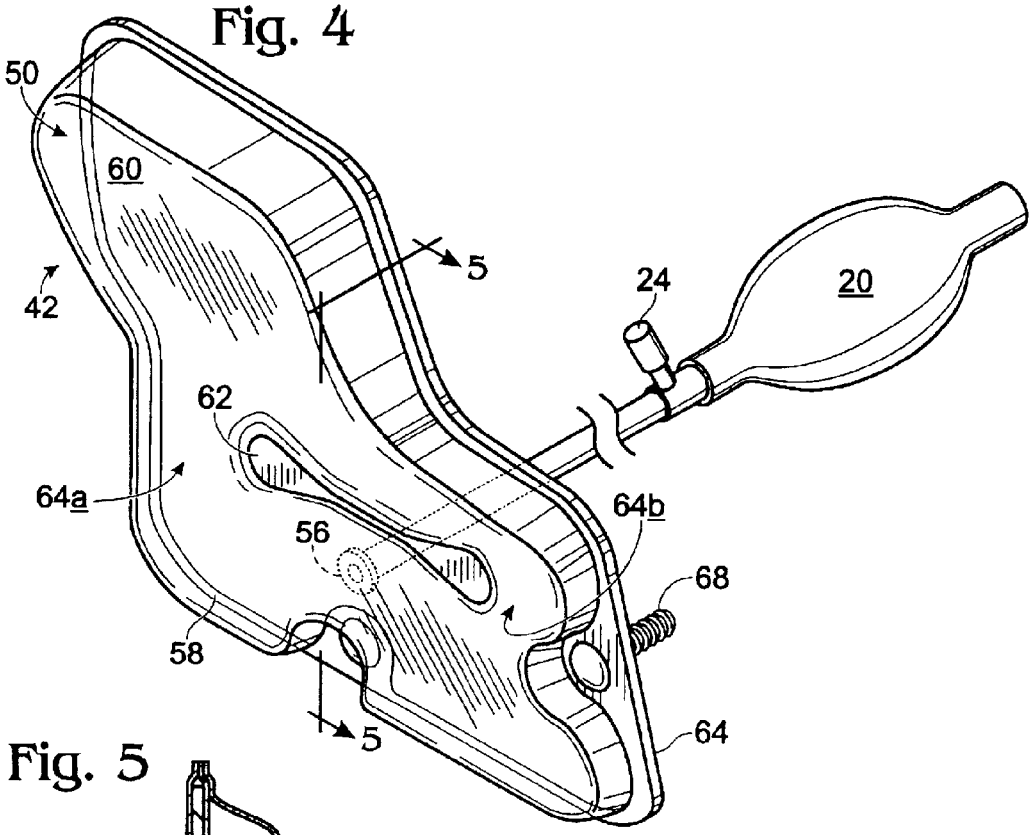
Fig. 5
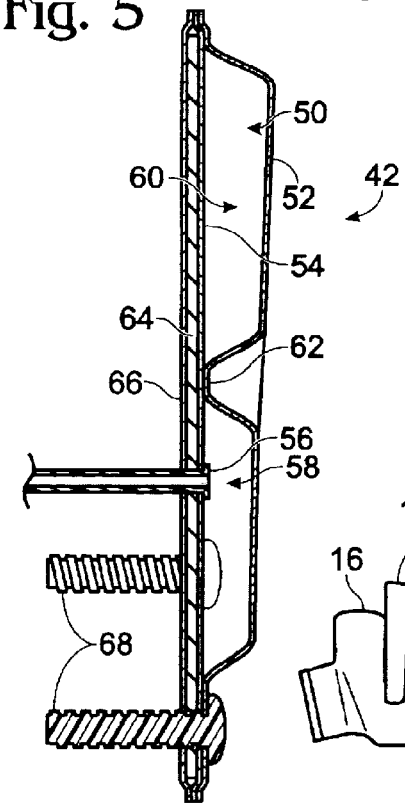
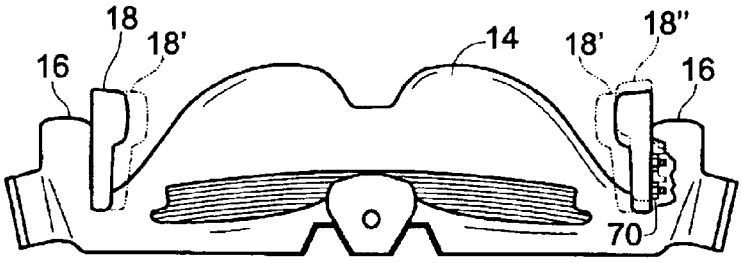
Fig. 6

OUTFITTING SYSTEM FOR A PERSONAL WATERCRAFT

CROSS-REFERENCE TO RELATED APPLICATION

This application is a continuation-in-part of U.S. patent application Ser. No. 10/215,361, filed Aug. 7, 2002 now U.S. Pat. No. 6,729,259, which is hereby incorporated by reference in its entirety.

TECHNICAL FIELD

The present invention relates to an outfitting system for a personal watercraft that includes items of outfitting adjustable by a user seated in a cockpit of the watercraft.

BACKGROUND OF THE INVENTION

Many types of personal watercraft, for example, whitewater, sea, and recreational flat-water kayaks, may include various items of outfitting configured to improve the comfort and fit of the watercraft. For example, a kayak may include a contoured seat to position and support the user within the cockpit, a back support to support the lower back of the user, and various types of thigh braces, foot braces and hip braces against which the user may exert force to control the boat, and which may help to hold the user in the boat.

To improve the performance of a kayak, a user may modify factory-installed outfitting to fit the user's body more precisely. For example, customized hip pads may be attached to the hip braces. These hip pads may help to hold the user's hips more snugly in the cockpit so that movements of the user's hips are transferred to the kayak more precisely and efficiently. Hip pads are typically formed from closed-cell foam, and are attached to the hip braces with a strong adhesive, such as contact cement, to prevent the pads from shifting or detaching during use. Additionally, extra padding may be added the seat, back support, thigh braces, etc. to likewise improve the fit of the boat.

Where a user anticipates running difficult whitewater or performing advanced freestyle moves, the user may install very snug outfitting for improved boat control. However, a great deal of time may be spent paddling easier water between difficult stretches, or sitting in the kayak in the relative calm of an eddy between freestyle sessions. In these situations, the outfitting may cause discomfort. However, because the outfitting may be glued into the cockpit and have a fixed shape, it may be difficult or impossible to loosen the outfitting between rapids or freestyle sessions. Likewise, where a looser, more comfortable fit in a kayak is desired, it may be difficult to increase the snugness of the outfitting for periods when more boat control is desired. Furthermore, user-installed outfitting is typically configured to fit just a single user optimally, thus making it difficult for multiple users to use a single watercraft.

SUMMARY OF THE INVENTION

One embodiment provides a personal watercraft, wherein the personal watercraft includes a cockpit configured to accommodate a user, a first item of outfitting coupled to the watercraft at least partially within the cockpit, wherein the first item of outfitting includes a first fluid-holding bladder inflatable by the user to increase the snugness of fit of the first item of outfitting on the user, a second item of outfitting coupled to the watercraft at least partially within the cockpit, wherein the second item of outfitting includes a second fluid-holding bladder inflatable by the user to increase the snugness of fit of the second item of outfitting on the user, a pump for inflating the first bladder and the second bladder, a fluid supply line connecting the first bladder and the second bladder to the pump, and a valve disposed along the fluid supply line, wherein the valve is configured to allow fluid flow from the pump to be selectively directed into at least one of the first bladder and the second bladder.

Another embodiment provides a personal watercraft including a cockpit, a seat disposed in the cockpit, wherein the seat include a first side and an opposing second side, and a first hip brace coupled to the first side of the seat and a second hip brace coupled to the second side of the seat, wherein at least one of the first hip brace and second hip brace is movably coupled to the seat such that a distance between the first hip brace and second hip brace is adjustable, and wherein each of the first hip brace and second hip brace is configured to receive attachment of a hip pad.

Yet another embodiment provides a personal watercraft including a cockpit, a seat assembly disposed in the cockpit, and a back support assembly coupled to the seat assembly, wherein the back support assembly includes a rigid support member, a pad, and a fluid-holding bladder disposed between the rigid support member and the pad.

Yet another embodiment provides a personal watercraft, wherein the personal watercraft includes a cockpit, a seat disposed in the cockpit, a pair of opposing hip braces coupled with the seat, and a back support coupled to the hip braces via at least one connecting member, wherein the back support is coupled to the connecting member via a fastener, and wherein the back support includes attachment features defining at least two different positions for coupling the back support to the connecting member.

BRIEF DESCRIPTION OF THE DRAWINGS

FIG. 2 is an isometric view of the kayak seat and outfitting system of the embodiment of FIG. 1.

FIG. 3 is a partially broken-away view of a hip pad of the embodiment of FIG. 1.

FIG. 4 is an isometric view of an air bladder of the hip pad of FIG. 3.

FIG. 5 is a sectional view of the air bladder of FIG. 4 taken along line 5—5 of FIG. 4.

FIG. 6 is a front view of the embodiment of FIG. 1, showing the hip pads in a first, looser position in solid lines, and in a second, tighter position in dashed lines.

DETAILED DESCRIPTION OF THE DEPICTED EMBODIMENT

Figure 1:
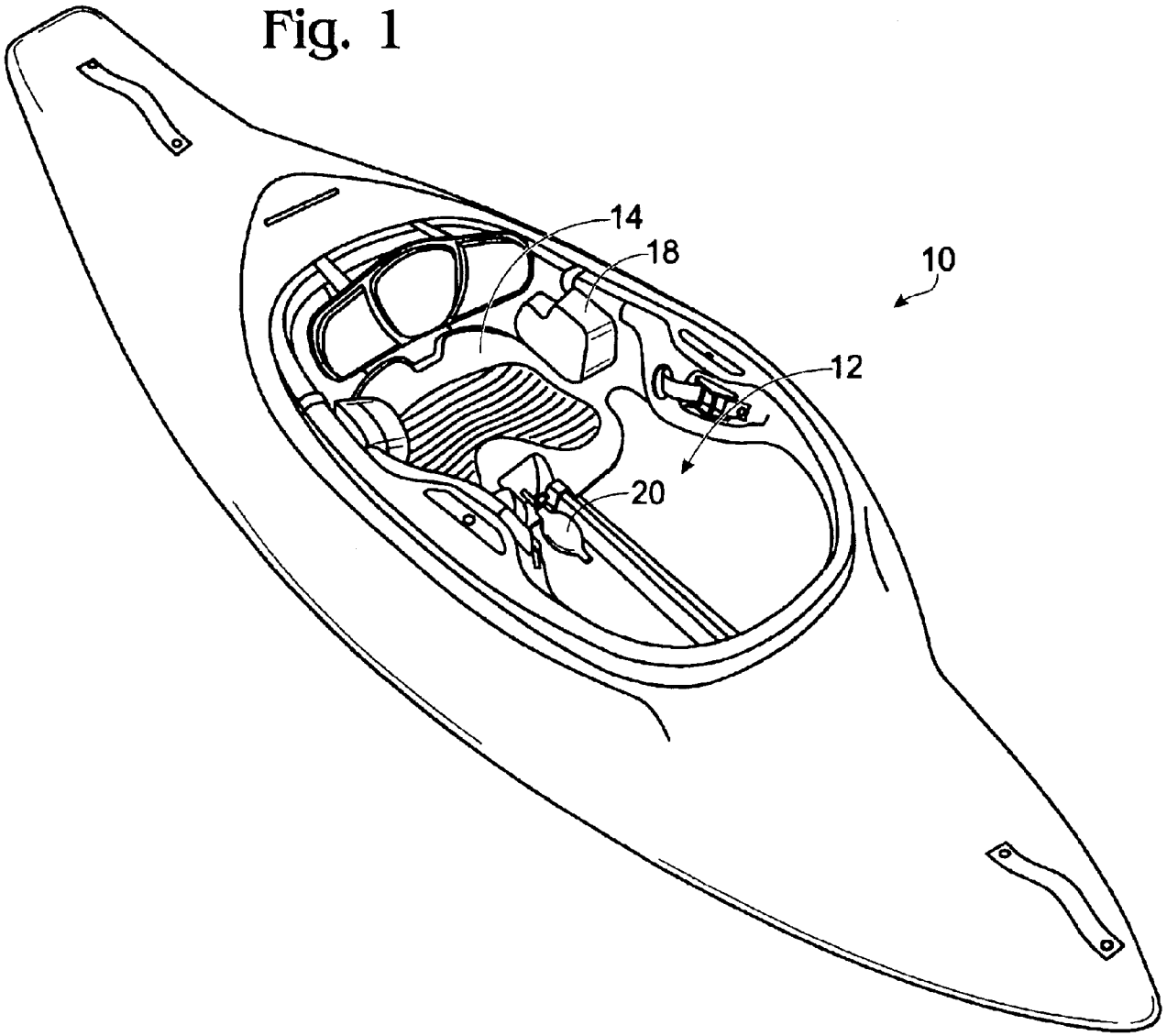
FIG. 1 is a view of a kayak having a first exemplary embodiment of an outfitting system according to the present invention.

FIG. 1 shows, generally at 10, a whitewater kayak having a cockpit 12 equipped with a seat 14. While the depicted embodiment is shown described in the context of a white-water kayak, it will be understood that an outfitting system according to the present invention may be used in any other suitable type of personal watercraft, including but not limited to, flat-water recreational kayaks, sea kayaks, decked and open canoes, inflatable watercraft, etc.

FIG. 2 shows seat 14 in more detail. Seat 14 includes an upturned hip brace 16 positioned on each side of the seat in a location adjacent to the hips of a user sitting in seat 14. To increase the accuracy of the fit of seat 14 and hip brace 16 on a user, seat 14 is equipped with a first exemplary embodiment of an outfitting system according to the present invention. The outfitting system includes a hip pad 18 attached to each hip brace 16. Hip pads 18 are configured fit snugly against the hips of a user sitting in seat 14 to permit more precise control of the kayak. To allow the tightness of the fit to be adjusted, each hip pad 18 is connected to a pump 20 via an air supply line 22. Pump 20 and air supply line 22 are configured to allow an air bladder contained within the hip pad to be selectively filled with air when a tighter fit is desired, and to be drained of air when a looser fit is desired. In this manner, a user may quickly, easily and reversibly loosen or tighten the fit of hip pads 18 at any desired time, while remaining seated in cockpit 12 of kayak 10. Furthermore, the fit of hip pads 18 may be adjusted extremely precisely, as the position of each hip pad is infinitely adjustable within its adjustability range.

Any suitable pumping device may be used to expand the bladder within each hip pad 18 (or any of the other embodiments described herein). In the depicted embodiment, pump 20 takes the form of a squeeze bulb such as that commonly used to inflate a blood pressure cuff. Pump 20 also may include a pressure release valve 24 operable to release air from hip pads 18. While the depicted pressure release valve 24 is integral with pump 20, it will be appreciated that the pressure release valve may be positioned at any other desired location on fluid supply line 22, or on either of hip pads 18. Additionally, while pump 20 is depicted as a squeeze bulb, any other suitable pumping device, or even a compressed gas source, may be used to expand hip pads 18. Furthermore, it will be appreciated that the pump may be configured to transport any other suitable fluid besides air, whether a liquid or gas, to expand hip pads 18.

Air supply line 22 may have any design suitable for transporting air (or other fluid) between hip pads 18, pump 20 and pressure release valve 24. In the depicted embodiment, air supply line 22 includes a first line segment 26 connecting pump 20 and pressure release valve 24 to a T-connector 28, and a pair of second tubes segments 30*a, b* that extend from the T-connector to hip pads 18. Line segments 26, 30*a* and 30*b* are positioned mostly underneath seat 14 in the depicted embodiment, with the exception of a small length of first line segment 26 that extends out of a hole 32 formed in seat 14. This allows pump 20 to be positioned approximately between and below a user's legs, and thus within easy reach of a user seated in cockpit 12. Furthermore, first line segment 26 may include some extra length so that a user may pull pump 20 a small distance away from seat 14 to facilitate use of the pump.

Positioning the tubes of air supply line 22 beneath seat 14 may help to prevent the tubes from being damaged during use, or when a user is entering or exiting cockpit 12. However, it will be appreciated that the tubes of air supply line 22 may also be positioned at any other desired location within cockpit 12.

Air supply line 22 may also be formed from any suitable components. For example, line segments 26, 30*a* and 30*b* may be formed from tubing with a relatively small diameter, as small diameter tubing may help slow the shifting of air between the two hip pads 18 during use. One example of a suitable inner diameter for line segments 26, 30*a* and 30*b* is 3/16", although tubes with either a larger or smaller inner diameter may also be used.

As mentioned above, fluid supply line 22 is configured to deliver air (or other fluid) to a bladder contained within each hip pad 18. FIG. 3 shows the construction of hip pad 18 in more detail. Hip pad 18 includes a relatively rigid shaped portion 40, and an air bladder 42 positioned behind the shaped portion. As a user pumps air into air bladder 42, the air bladder expands and pushes shaped portion 40 more firmly against the hip of the user. Shaped portion 40 is configured to retain its shape regardless of the pressure exerted by air bladder 42, and thus to fit the hip of a user in the cockpit regardless of the amount of air in the air bladder.

Shaped portion 40 and air bladder 42 may be held in position relative to one another in any suitable manner. In the depicted embodiment, shaped portion 40 and air bladder 42 are each contained within an outer cover 44. Outer cover 44 may be formed from any suitable material. Suitable materials include, but are not limited to, elastic fabrics, such as spandex or a blended spandex fabric. Outer cover 44 may be permanently secured to shaped portion 40 and/or air bladder 42, for example, by sewing or gluing, or both the shaped portion and air bladder may be removable from outer cover. Where outer cover 44 is permanently secured to shaped portion 40, a pocket (not shown) may be provided in the back of outer cover 44 to accept the insertion of bladder 42.

Shaped portion 40 may have any suitable configuration. In the depicted embodiment, shaped portion 40 is configured to conform to the curvature of a user's hip and upper thigh. Thus, shaped portion 40 includes a lower portion 46 configured to push laterally against the user's hip to prevent side-to-side motion in the cockpit, and an upper portion 48 that curves at least partially over the top of the user's hip to help hold the user down against seat 14.

Likewise, shaped portion 40 may be formed from any suitable material or materials. Suitable materials include those that are able to generally retain shape under stress, that are lightweight, and/or that are comfortable against a user's body. Examples of suitable materials include, but are not limited to, closed-cell foams, such as a thermoformed EVA foam. Another suitable alternative may be to form shaped portion 40 from a rigid or semi-rigid plastic material covered with a layer of padding.

FIGS. 4 and 5 show bladder 42 in more detail. Bladder 42 includes an air chamber 50 formed from a material with a low permeability to air, and with sufficient flexibility to allow the volume of the air chamber to collapse and expand as needed. One example of a suitable material for the construction of air chamber 50 is polyurethane. In the depicted embodiment, air chamber 50 is formed from an outer piece 52 of polyurethane (or other suitable material) bonded to an inner piece 54 of polyurethane along its perimeter. Air supply line 22 extends into air chamber 50, and is bonded to the air chamber where it enters the air chamber. Air supply line 22 may include a flared end portion 56 to provide more surface area for forming a stronger bond to inner piece 54 of air chamber 50.

Outer piece 52 and inner piece 54 of air chamber 50 may be bonded together in any suitable manner to form air chamber 50. For example, outer piece 52 and inner piece 54 may be bonded together with a strong adhesive that is impermeable to the gasses in air. Alternatively, where outer piece 52 and inner piece 54 are formed of a polymer such as polyurethane, they may be bonded together by a suitable plastic welding technique, such as RF welding. The use of RF welding may be advantageous, as it may create a seam with the same strength and tear resistance as the bulk portions of the polyurethane.

During use, a user may exert a great deal of force against hip pads 18 in a very dynamic manner. For example, the user may be exerting force upwardly against upper portion 48 of hip pad 18 at one instant, and then against lower portion 46 of the hip pad at the next instant. Where air is able to flow freely in air chamber 50 between upper portion 48 and lower portion 46 of hip pad 18, the fit of the hip pad against the user may feel somewhat inconsistent and less secure as air flows within air chamber 50 in response to the user's motions. Therefore, air chamber 50 may also include one or more baffles configured to slow the flow of air between the lower portion of the air chamber, indicated at 58, and the upper portion of the air chamber, indicated at 60.

Any suitable structure for slowing the flow of air between lower portion 58 and upper portion 60 of air chamber 50 may be used as a baffle. In the depicted embodiment, the baffle, indicated at 62, takes the form of a region in the center of air chamber 50 in which outer piece 52 and inner piece 54 of air bladder 50 are bonded to one another. This leaves only a pair of relatively narrow channels 64*a* and 64*b* through which air may flow between the lower portion 58 and upper portion 60 of air chamber 50. This may help to prevent the rapid shift of air within air chamber 50 during use, and thus may help to increase the stability and consistency of fit of hip pads 18 against the user.

As described above, outer piece 52 and inner piece 54 of air chamber 50 are typically formed from a flexible material. To hold air chamber 50 in the correct shape, and to provide a structure with which hip pad 18 may be attached to hip brace 16, bladder 42 may also include a rigid support member 64. Support member 64 may be attached to the other components of bladder 42 in any desired manner. In the depicted embodiment, support member 64 is secured to the other components of bladder 42 by an additional backing piece 66 of material that is bonded to the perimeters of outer piece 52 and inner piece 54 of air chamber 50 to enclose the support member completely. Support member 64 may be formed from any suitable material. One example of a suitable material is rubberized polystyrene, as rubberized polystyrene is stiff, strong, lightweight, and does not absorb water. Likewise, backing piece 66 may also be formed from any suitable material. It may be desirable to form backing piece 66 from the same material as outer piece 52 and inner piece 54 of air chamber 50 to permit backing piece 66 to be bonded strongly to the other pieces via RF welding.

Hip pad 18 may be attached to hip brace 16 in any suitable manner. For example, hip pad 18 may be attached to hip brace 16 with a suitable adhesive, such as contact cement, or with one or more rivets. However, in the depicted embodiment, hip pad 18 includes a pair of threaded bolts 68 for attaching the hip pad to hip brace 16. The use of bolts to attach hip pad 18 to hip brace 16 may allow the position of hip pad 18 within cockpit to be adjusted, as described in more detail below. While the depicted hip pad includes two bolts for attaching the pad to hip brace 16, either more or fewer bolts may be used if desired.

FIG. 6 shows a simple schematic illustrating the adjustability of hip pads 18. Where bladder 42 is drained of air, hip pads 18 are positioned in a looser configuration, closer to the sides of cockpit 12 as indicated in solid lines. On the other hand, where bladder 42 is filled with air, hip pads 18 are positioned in a tighter configuration, further from the sides of cockpit 12, as indicated in dashed lines at 18'. It will be appreciated that hip pads 18 are infinitely adjustable between the fully inflated and fully deflated configurations of bladder 42, and thus may be positioned at any location within the range of possible adjustability, typically 1–3 inches at each hip pad, although the hip pads may have a greater or lesser range of adjustability if desired.

Figure 7:
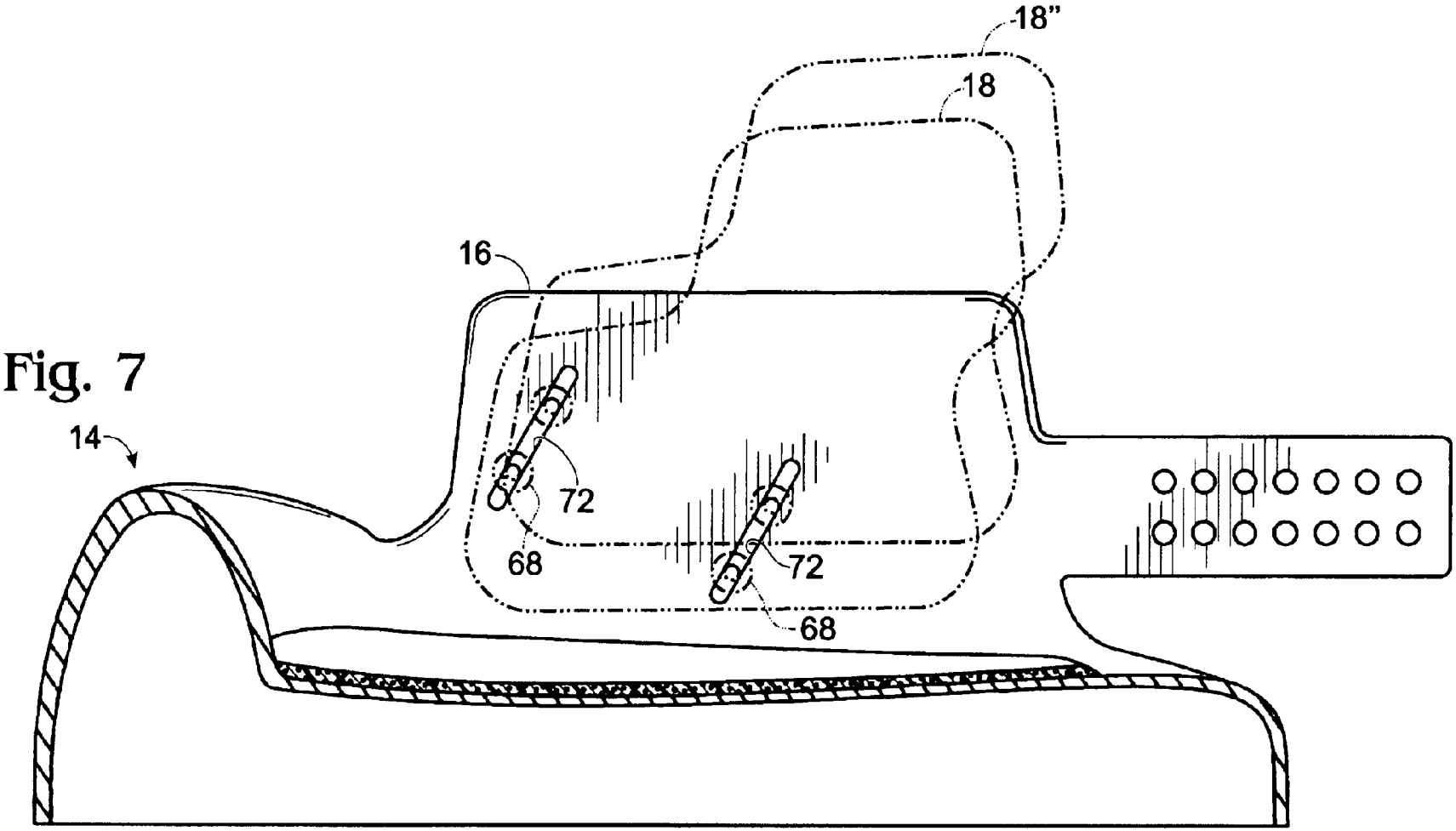
FIG. 7 is a side view of the seat and hip pad of the embodiment of FIG. 1 taken along line 7—7 of FIG. 2, showing two possible positions of the hip pad relative to the seat.

FIGS. 6 and 7 also show a vertical adjustment capability of hip pad 18, as indicated at 18". As described above, each hip pad includes a pair of bolts 68 with which the hip pads are attached to hip braces 16. In turn, each hip brace 16 may include elongate slots, shown at 72 in FIG. 7, configured to receive bolts 68. The use of elongate slots 72 may allow the position of hip pad 18 relative to hip brace 16 to be adjusted by simply moving bolts 68 along the slots until hip pad 18 is in a desired position, and then fixing the bolts in the slots with nuts 70. Slots 72 may be oriented in any desired direction, and may have any suitable length. For example, the slots may be oriented in a true vertical orientation, or may be oriented at an angle from the vertical, for example, 30 degrees forward from the vertical, as shown in FIG. 7. Additionally, where hip pad 18 includes two bolts 68 for attaching the hip pad to hip brace 16, the pitch of the hip pad may also be varied by loosening and shifting only one bolt while holding the other bolt fixed. Alternatively, rather than slots 72, hip brace 16 may also include a plurality of individual holes into which bolts 68 may be extended, wherein each hole defines a different position of hip pad 18.

Figure 8:
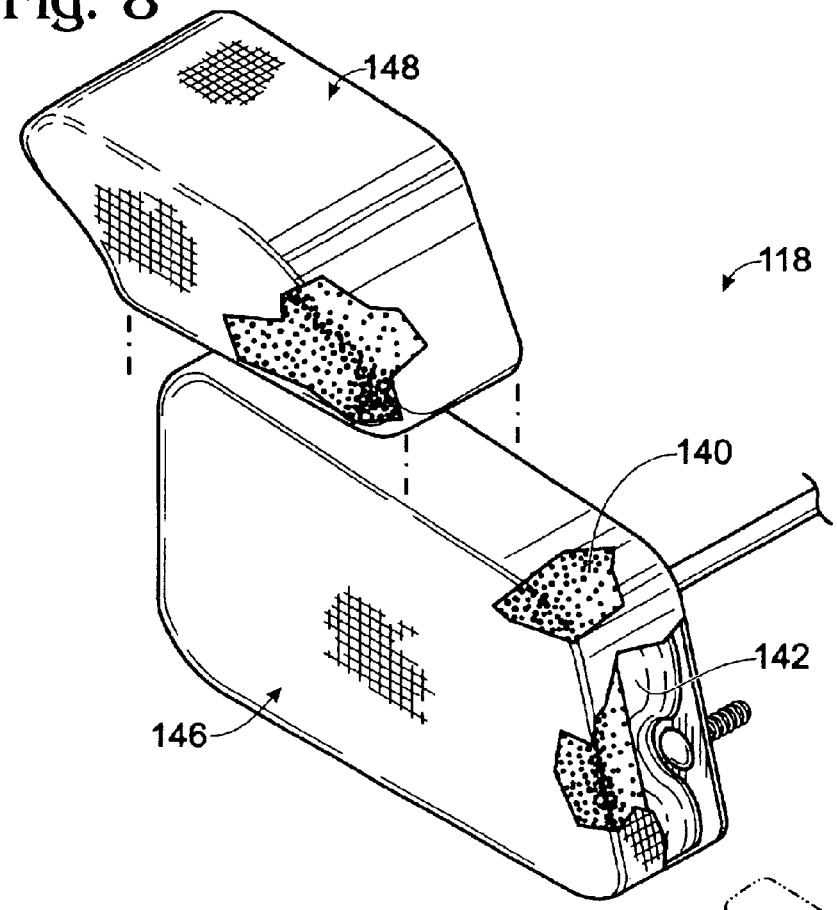
FIG. 8 is a partially broken-away view of a hip pad according to another embodiment of the present invention.

FIG. 8 shows, generally at 118, another embodiment of a hip pad according to the present invention. Like the embodiment of FIG. 3, hip pad 118 includes a relatively rigid shaped portion 140, and an air bladder 142 positioned behind the shaped portion. As a user pumps air into air bladder 142, the air bladder expands and pushes shaped portion 140 more firmly against the hip of the user. Shaped portion 140 is configured to retain its general shape regardless of the pressure exerted by air bladder 42, and thus to fit the hip of a user in the cockpit regardless of the amount of air in the air bladder. Furthermore, hip pad 118 includes a lower portion 146 configured to push laterally against a user's hip, and an upper portion 148 that extends at least partially over the top of the user's hip to help hold the user down against seat 114.

However, unlike the embodiment of FIG. 3, the lower portion 146 and upper portion 148 of hip pad 118 are separate pieces, rather than integral. Furthermore, bladder 142 is positioned behind only lower portion 146 of hip pad 118, and not upper portion 148. Inflating bladder 142 thus tightens the side-to-side fit of the outfitting without increasing the pressure exerted on the user's leg by upper portion 148. This may allow greater control to be achieved with less discomfort when bladder 142 is inflated to be tight against the user's body. Upper portion 148 may be attached to the kayak hip brace, lower portion 146, or both the hip brace and lower portion of the hip pad, to hold the upper portion of the hip pad in a desired position relative to the lower portion of the hip pad.

Figure 9:
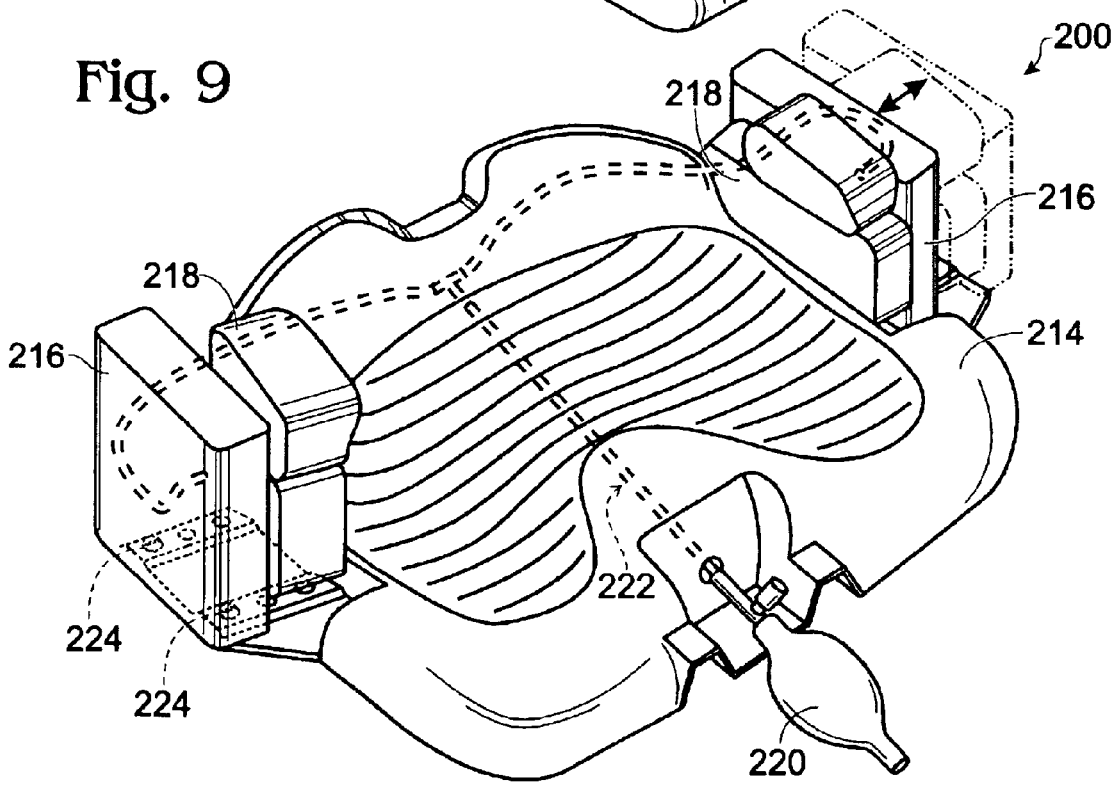
FIG. 9 is an isometric view of a kayak seat and outfitting system according to another embodiment of the present invention.

FIG. 9 shows, generally at 200, another embodiment of an outfitting system according to the present invention. Outfitting system 200 includes a seat 214, an upturned hip brace 216 positioned on each side of the seat in a location adjacent to the hips of a user sitting in seat 214, and a hip pad 218 attached to each hip brace. Additionally, hip braces 216 are movably coupled to seat 214. This permits the positions of hip pads 218 to be adjusted on a larger scale than possible with just the air bladders alone. With outfitting systems in which the hip braces are coupled to the seat in a fixed position, smaller users typically must add extra layers of outfitting foam between the hip pads and hip braces to achieve an adequately snug fit. Likewise, larger users may be too large to fit comfortably between the hip braces with even a thin set of hip pads. Thus, movably coupling hip braces 216 to seat 214 may help to enable users of a wide range of body sizes to utilize outfitting system 200 without the need to add or remove any additional foam to or from the hip pads.

Hip braces 216 may be movably coupled to seat 214 in any suitable manner. For example, seat 214 may include one or more elongate slots through which a bolt or other fastener attached to hip braces 216 is extended and secured. The use of elongate slots as attachment features may allow hip braces 216 to be secured to seat 214 in any position along the slots, and thus may allow adjustments of a relatively fine degree to be made. Alternatively, as depicted in FIG. 9, seat 214 may include a plurality of holes 224 positioned in incrementally greater distances from the center of seat 214. This allows hip braces 216 to be fixed in a plurality of discrete positions relative to seat 214. This may help to prevent outward slippage of hip braces 216 under rigorous use conditions, and also may help to ensure that the hip braces may be easily positioned at equal distances from the center of seat 214. Once a user selects a suitable set of holes 224 to which to mount each hip brace, fine adjustment of the fit of outfitting system 200 may be accomplished via the air bladders in hip pads 218. As an alternative embodiment, the seat may include only a single set of holes that may be matched to a plurality of different sets of holes on the hip brace to provide for the positional adjustability of the hip brace.

Figure 10:
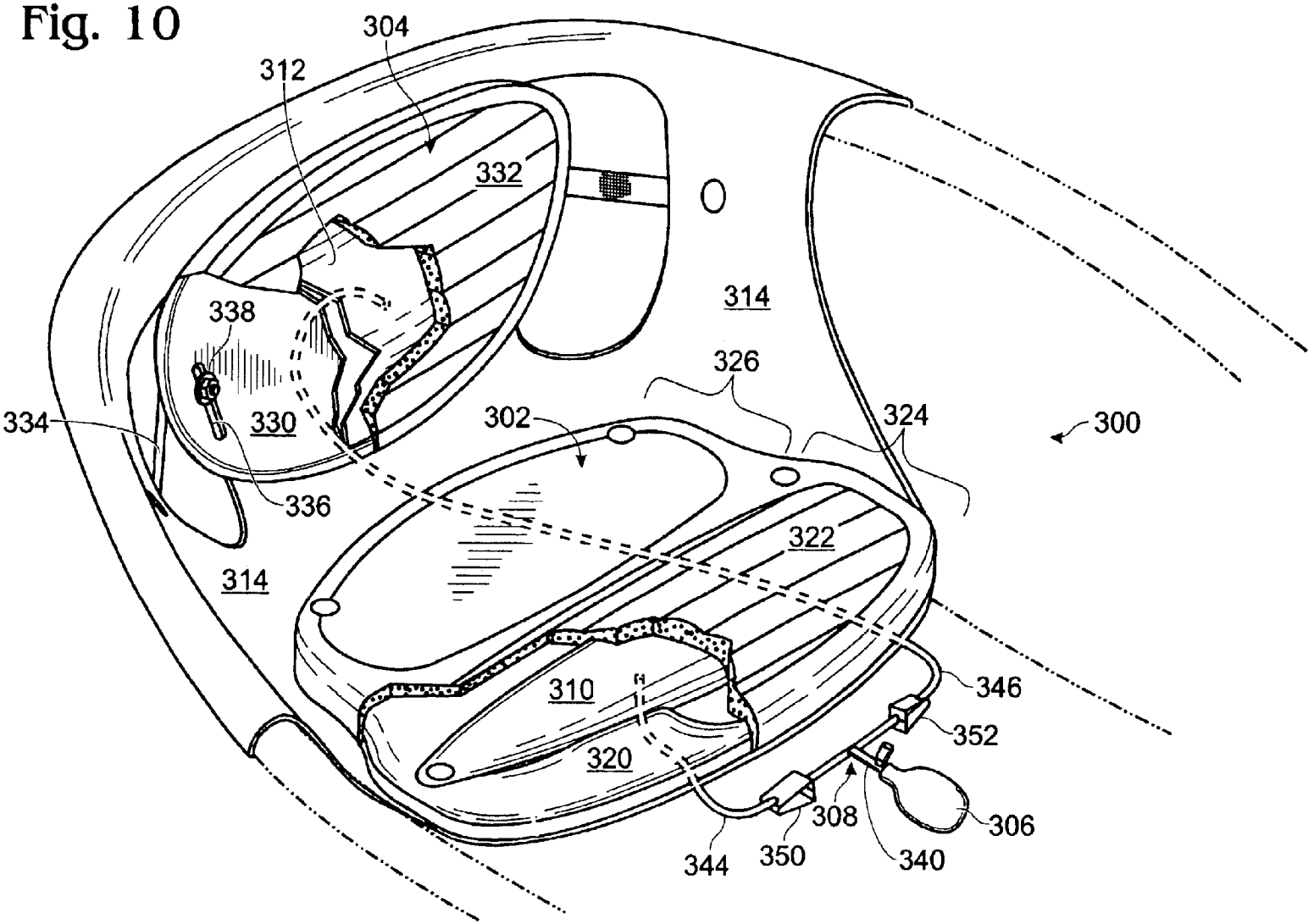
FIG. 10 is a view of another embodiment of an outfitting system according to the present invention.

FIG. 10 shows, generally at 300, another embodiment of an outfitting system for a personal watercraft, positioned within the cockpit of a kayak. Outfitting system 300 includes a seat assembly 302, and a back support assembly 304 positioned behind and above the seat assembly. Seat assembly 302 and back support assembly 304 are each connected to a pump 306 via an air supply line 308 that allows a pair of air bladders 310 and 312 contained within the seat assembly and the back support assembly, respectively, to be selectively filled with air when greater support within the cockpit is desired. FIG. 10 depicts seat assembly 302 and back support assembly 304 in the context of a recreational flatwater kayak. Hence, hip braces 314 are not configured to closely contact a user's hips, but instead merely support seat assembly 302 in a desired position within the cockpit. However, it will be appreciated that a seat assembly and back support assembly according to the present invention may also be used in a whitewater kayak, sea kayak, decked or open canoe, or any other suitable personal watercraft, and with any other suitable items of outfitting, including the hip pads disclosed herein.

Seat assembly 302 includes a support member 320, and a pad 322 substantially covering the support member. Support member 320 is typically made of a rigid material, and is configured to support a user seated in the cockpit. Pad 322 is configured to provide a cushioned seating surface. Both support member 320 and pad 322 include a front portion 324 configured to support a user's thighs, and a rear portion 326 configured to support the user's posterior.

Bladder 310 is disposed between support member 320 and pad 322, and is positioned beneath only front portion 324 of the pad. Thus, inflation of bladder 310 helps to support a user's thighs in an elevated position typically used in a kayak cockpit. However, because bladder 310 is not positioned under rear portion 326 of the pad, inflating the bladder does not raise the posterior of the user, and thus does not raise the user's center of gravity in the boat. Thus, bladder 310 helps to provide greater support without decreasing the stability of the kayak. Alternatively, bladder 310 may be configured to extend under the rear portion 326 of pad 322.

Likewise, back support assembly 304 also includes a support member 330, and a pad 332 substantially covering the support member. Support member 330 is configured to support the weight of a user leaning against back support assembly 304 without deforming, and pad 332 is provided for added comfort, as well as to cover bladder 312.

Back support assembly 304 may be configured to support any desired portion of a user's back. For example, back support assembly 304 may be positioned in the cockpit at an appropriate level to support a user's lumbar region. Bladder 312 may then be selectively inflated or deflated to respectively increase or decrease the amount of lumbar support provided by back support assembly. Alternatively, back support assembly 304 may be positioned to support a user's back at a location other than the lumbar region.

The height of back support assembly 304 above seat assembly 302 may be configured to be adjustable to accommodate users of a wide range of heights. In the depicted embodiment, back support assembly 304 is coupled to hip braces 314 via a connecting member 334 that extends behind the back support assembly and connects to each hip brace. Thus, back support assembly 304 may include attachment features defining at least two different positions at which the back support is attachable to the connecting member. In the depicted embodiment, support member 330 of back support assembly 304 includes one or more elongate slots 336. Each slot 336 is configured to receive a fastener 338 coupled to connecting member 334. The height of back support assembly 304 may be adjusted simply by loosening each fastener 338, sliding back support assembly 304 to a desired position, and retightening the fasteners. While the attachment features are depicted as one or more slots formed in support member 330 of back support assembly 304, it will be appreciated that the attachment features may take the form of a plurality of discrete holes arranged vertically along the support member, rather than an elongate slot. Furthermore, while the attachment features are depicted as being associated with support member 330, the attachment features may instead be formed in or otherwise associated with connecting member 334.

As with the embodiment of FIG. 2, air supply line 308 may have any configuration suitable for transporting air (or other fluid) between pump 306, seat assembly bladder 310, and back support assembly bladder 312. In the depicted embodiment, air supply line 308 includes a first line segment 340 connecting pump 306 to a T-connector 342, a second line segment 344 that extends from the T-connector to seat assembly bladder 310, and a third line segment 346 that extends from the T-connector to back support assembly bladder 312. Line segments 340, 344 and 346 are depicted as positioned mostly underneath seat assembly 302, and pump 306 is depicted as positioned approximately between and below a user's legs, and thus within easy reach of a user seated in cockpit 12. However, line segments 340, 344 and 346, and pump 306, may be positioned in any other suitable locations other than those shown.

Air supply line 308 may include a mechanism that allows independent control of the inflation and deflation of seat assembly bladder 310 and back support assembly bladder 312. For example, each bladder may be inflated by a different pump, and deflated by a different pressure release valve. Alternatively, one or more valves may be used to control the flow of air from a single pump through second line segment 344 and third line segment 346. In the depicted embodiment, a first valve 350 controls airflow to and from seat assembly bladder 310, and a second valve 352 controls airflow to and from back support assembly bladder 312. Using valves 350 and 352, a user may selectively inflate or deflate bladder 310 alone, bladder 312 alone, or bladders 310 and 312 simultaneously by opening and/or closing valves 350 and 352 appropriately. This allows a user to individually tailor the support offered by each of seat assembly 302 and back support assembly 304 without affecting the other.

Figure 11:
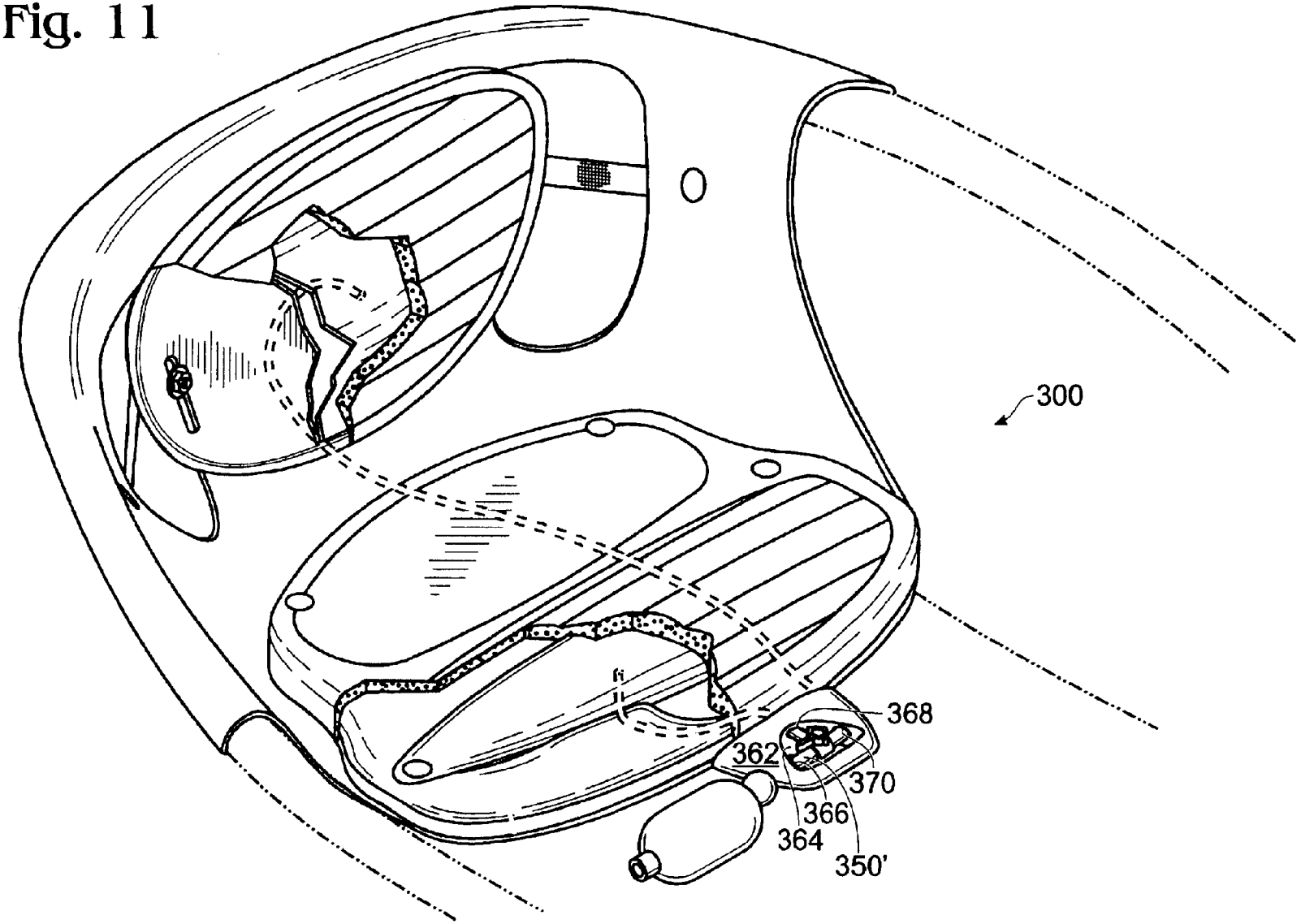
FIG. 11 is a view of the embodiment of FIG. 10, showing an alternate valve configuration.

FIG. 11 shows an alternate embodiment of a valve system for controlling the selective inflation and deflation of seat assembly bladder 310 and back support assembly bladder 312. Instead of utilizing separate valves for controlling the flow of air into and out of each bladder, a single valve 350' is positioned at the junction of first line segment 340, second line segment 344 and third line segment 346. Any suitable valve capable of directing flow from an inlet into at least one of two possible outlets may be used for valve 350'. For example, valve 350' may be a simple cockstop-style valve. Furthermore, valve 350' may be configured to permit inflation of both bladders simultaneously, to permit inflation of only one bladder at a time, or to allow any combination of bladders to be inflated.

A mount 360 may be provided to hold valve 350' and pump 306 in place relative to seat assembly 302. Mount 360 may help to prevent pump 306 and valve 350' from shifting during use, and thus may help to make the pump and valve easier for a user to locate. The depicted mount 360 includes a frame 362 defining an opening 364 allowing access to valve 350'. Mount 360 also includes apertures 366, 368 and 370 through which first line segment 340, second line segment 344 and third line segment 346 respectively extend. However, mount 360 may have any other suitable configuration that holds valve 350' in place and allows a user to easily access the valve.

Mount 360 may be coupled to, or integral with, seat assembly 302, or may be fixed in a desired position within the kayak cockpit in any other suitable manner. Furthermore, while mount 360 is shown positioned below and approximately between a user's legs, mount 360 may be located in any other suitable position within the kayak cockpit.

It will be appreciated that many different combinations of the items of outfitting disclosed herein may be used other than the exemplary combinations shown and described, and that any suitable valve system may be used to allow each bladder, or any desired combination of bladders, within an outfitting system to be inflated and/or deflated as desired. Furthermore, although the present disclosure includes specific embodiments, specific embodiments are not to be considered in a limiting sense, because numerous variations are possible. The subject matter of the present disclosure includes all novel and nonobvious combinations and subcombinations of the various elements, features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A personal watercraft, comprising:

a cockpit;

a seat disposed in the cockpit, wherein the seat includes a first side and an opposing second side; and a first hip brace coupled to the first side of the seat and a second hip brace coupled to the second side of the seat, wherein both the first hip brace and the second hip brace are movably coupled to the seat such that a distance between the first hip brace and second hip brace is adjustable, and, wherein each of the first hip brace and second hip brace is configured to receive attachment of a hip pad;

wherein the seat includes a first channel adapted to receive the first hip brace and a second channel adapted to receive the second hip brace, and wherein each channel includes a plurality of attachment features configured to permit the attachment of each hip brace at least two different locations.

2. The personal watercraft of claim 1, wherein the attachment features are apertures formed in the channels, and wherein the apertures are configured to receive fasteners coupled to each hip brace.

* * * * *